US011413776B2

(12) United States Patent
McGarry et al.

(10) Patent No.: US 11,413,776 B2
(45) Date of Patent: Aug. 16, 2022

(54) SHAVING RAZOR SYSTEM

(71) Applicant: The Gillette Company LLC, Boston, MA (US)

(72) Inventors: Rory Frederick Wellington McGarry, Boston, MA (US); Jonathon Albert Riehle, Brighton, MA (US)

(73) Assignee: The Gillette Company LLC, Boston, MA (US)

( * ) Notice: Subject to any disclaimer, the term of this patent is extended or adjusted under 35 U.S.C. 154(b) by 9 days.

(21) Appl. No.: 17/116,342

(22) Filed: Dec. 9, 2020

(65) Prior Publication Data

US 2022/0176577 A1 Jun. 9, 2022

(51) Int. Cl.
*B26B 21/52* (2006.01)

(52) U.S. Cl.
CPC ..... *B26B 21/521* (2013.01); *B26B 21/522* (2013.01); *B26B 21/52* (2013.01)

(58) Field of Classification Search
None
See application file for complete search history.

(56) References Cited

U.S. PATENT DOCUMENTS

| | | | | |
|---|---|---|---|---|
| 7,975,389 | B2 * | 7/2011 | Bozikis | B26B 21/522 30/32 |
| 9,731,427 | B2 * | 8/2017 | Gratsias | B26B 21/521 |
| 10,486,321 | B2 * | 11/2019 | Gratsias | B26B 21/225 |
| D877,982 | S * | 3/2020 | Bittencourt | D28/46 |
| D935,097 | S * | 11/2021 | Riehle | D28/48 |
| 2017/0173809 | A1 * | 6/2017 | Psimadas | B26B 21/222 |
| 2019/0077033 | A1 * | 3/2019 | Hodgson | B26B 21/18 |
| 2020/0086516 | A1 * | 3/2020 | Brellis | B26B 21/52 |
| 2020/0398450 | A1 * | 12/2020 | Brellis | B26B 21/522 |
| 2021/0299898 | A1 * | 9/2021 | McDaniel | B26B 21/225 |

OTHER PUBLICATIONS

All Office Actions, U.S. Appl. No. 29/761,436.
All Office Actions, U.S. Appl. No. 29/761,438.

* cited by examiner

*Primary Examiner* — Hwei-Siu G Payer
(74) *Attorney, Agent, or Firm* — John M. Lipchitz

(57) ABSTRACT

A shaving razor system with a cartridge having a proximal end and a distal end. A handle having a proximal end is connected to the distal end of the cartridge. The handle has an enlarged distal end portion. The handle has a maximum width of 28 mm to 35 mm at the enlarged distal end portion and tapers 10 degrees to 15 degrees along a first length that extends a terminal end of the handle to a second width of 20 mm to 25 mm toward the proximal end. The handle has a maximum thickness of 8 mm to 14 mm along the first length.

20 Claims, 2 Drawing Sheets

SHAVING RAZOR SYSTEM

FIELD OF THE INVENTION

The present invention relates to wet shaving safety razors and more particularly to shaving razor systems that have a shaving razor cartridge mounted to an ergonomically formed handle for shaving a person's head.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled.

Razor blade assemblies have been disclosed wherein cutting edge portions of the blade members are held between skin engaging surfaces which are generally referred to as the guard and cap of the razor blade assembly. The guard contacts the skin in front of the blade member(s) and the cap contacts the skin behind the blade member(s) during a shaving stroke. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Head shaving has been steadily growing among men over the last several years. However, there are limited options available that specifically designed for head shaving. Certain razors that target head shaving consumers have handles with loops or rings to hold a user's hand or finger(s) during a shaving stroke. However, these designs restrict how the user can hold the handle of the shaving razor. Other shaving devices that were originally designed to shave the face, such as electric razors and safety razors also do not lend themselves well when shaving the head. The task of head shaving requires extreme care, patience, coordination and spatial awareness to avoid cutting the head. Head shaving is more difficult than shaving one's face because in certain positions the shaving razor cannot be seen in the mirror by the user Thus, there is a need for a shaving razor system having an ergonomic handle to allow for proper control and manipulation for shaving one's face.

SUMMARY OF THE INVENTION

In one aspect, the invention features, in general a shaving razor system with a cartridge having a proximal end and a distal end. A handle having a proximal end is connected to the distal end of the cartridge. The handle has an enlarged distal end portion. The handle has a maximum width of 28 mm to 31 mm at the enlarged distal end portion and tapers 10 degrees to 15 degrees along a first length that extends a terminal end of the handle to a second width of 21 mm to 25 mm toward the proximal end.

In another aspect, the invention features, in general a shaving razor system with a handle having a proximal end portion configured to attach to a shaving razor cartridge. The handle has a terminal end. The handle has an enlarged distal end portion between the proximal end portion and the terminal end having maximum width of 28 mm to 31 mm measured within 5 mm of a terminal end. The handle has a second width of 21 mm to 25 mm between the maximum width and the proximal end portion and a first length of 50 mm to 70 mm between the terminal end and the second width.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

When shaving your face with a razor handle is typically held at an angle between 30 degrees and parallel to the place of the surface of the skin being shaved, either in the form of downward strokes or upstrokes. This arrangement is generally comfortable and intuitive for the user and also provides good visibility when shaving in front of a mirror. The hand is kept a good distance from the shave surface, meaning that the reflected view of the area being shaved is not obscured by the shaver's own hand. This scenario has shaped the way razors have been designed and optimized for over one hundred years. However, the positional relationship between a shaving razor handle and the head may vary significantly depending on the location on the head that is being shaved.

Figure 1:
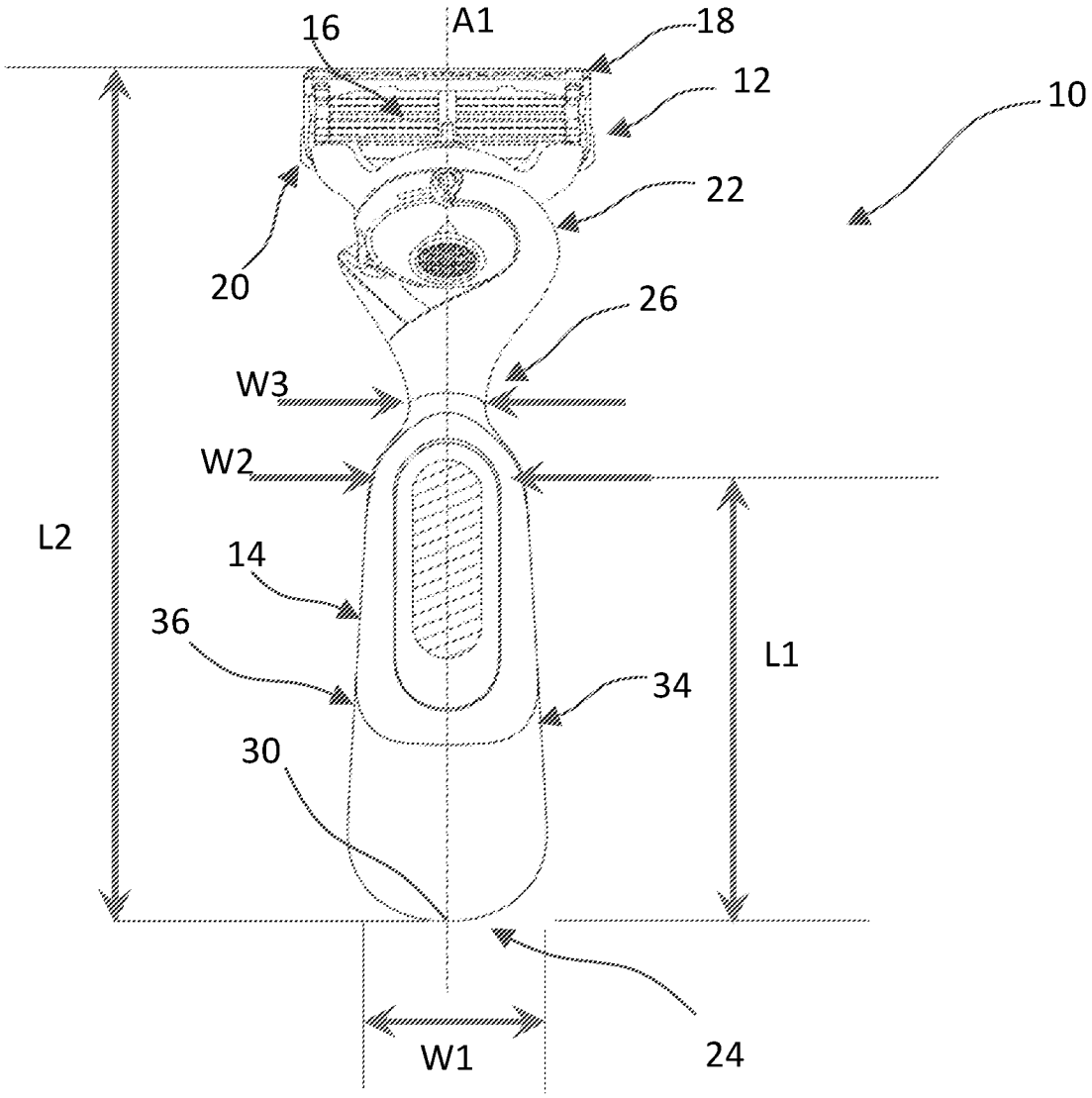
FIG. 1 is a front view of a shaving razor system.

Referring to FIG. 1 a front view of a shaving razor system 10 is shown. A shaving razor cartridge 12 may be mounted to a handle 14 that extends generally along a longitudinal axis A1. The shaving razor cartridge 12 may have at least one blade 16 for cutting hair. The at least one blade 16 may be positioned between a proximal end 18 and a distal end 20 of the shaving razor cartridge 12. The handle 14 may have a proximal end portion 22 an enlarged distal end portion 24. The distal end 20 of the cartridge 12 may be mounted to the proximal end portion 22 of the handle 14. The handle 14 may include a neck 26. The greatest width of the handle 14 may be located at the enlarged distal end portion 24. For example, handle 14 (the enlarged distal end portion 24 of the handle) may have a maximum width "W1" of about 28 mm to about 35 mm. The width "W1" may be measured up to 5 mm from a terminal end 30 of the handle 14. The handle 12 may taper about 10 degrees to 15 degrees along a first length "L1" that extends from the terminal end 30 to a second width "W2" toward the proximal end portion 22 that is less than W1. For example, W2 may be about 20 to about 25 mm. In certain embodiments, the first length "L1" may be about 50 mm to about 70 mm. The neck 26 may have a width "W3" that is less than W2. For example, the width "W3" may be about 10 mm to about 15 mm. The neck 26 may be positioned between W2 and the proximal end portion 22 of the handle 14. The neck 26 may provide the user an area of the handle 14 to pinch between their thumb and index finger that is closer to the cartridge 12 for improved control. The taper of the handle 12 may facilitate smooth transition from holding the handle 12 between the neck 26 and the distal end portion 24 to holding the handle at the neck 26. The dimensions W1, W2 and W3 may be taken from a top surface 40 (see FIG. 2) of the handle 14 (i.e., opposite the side of the shaving razor system 10 that is facing the surface to be shaved).

In certain embodiments, the shaving razor system 10 may have an overall length "L2" that extends from the terminal end 30 of the handle 14 to the proximal end 18 of the shaving razor cartridge 12. The overall length "L2" may be about 100 mm to 130 mm, which is shorter than typical wet shaving razors to provide for more control when shaving the head. Shaving razors that are too long can be clumsy to maneuver and shaving razors that are too short may not provide sufficient surface area to hold and control the handle for longer shaving strokes.

Figure 2:
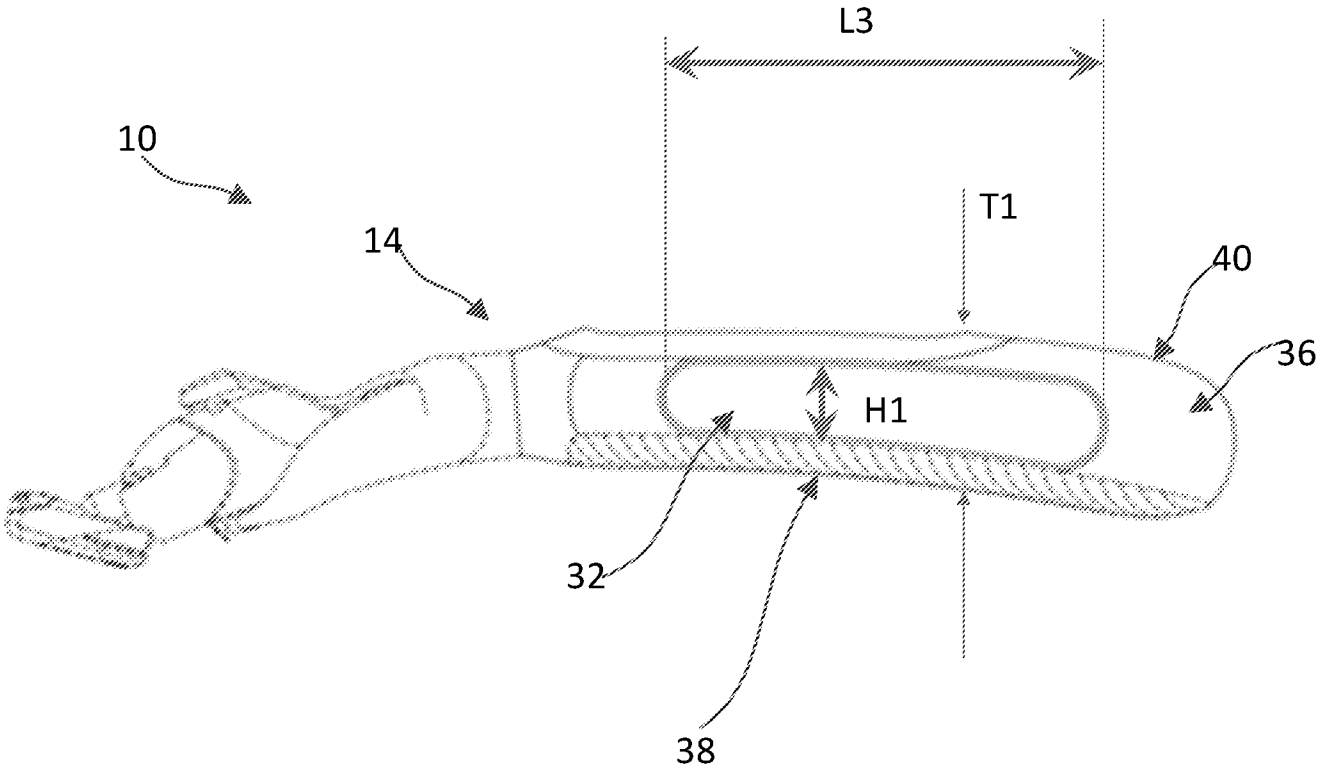
FIG. 2 is a side view of the shaving razor system of FIG. 1.

Referring to FIG. 2, a side view of the shaving razor system 10 is illustrated. The shaving razor handle 14 may have a maximum thickness "T1" between about 8 mm to about 14 mm along the length "L1" (FIG. 1). In certain embodiments, the handle 14 may be manufactured from one or more metals. The weight of the handle can also impact the feel and comfort when held in a user's hand. In certain embodiments, the handle 14 may have a weight of about 50 grams to about 100 grams and more preferably about 50 grams to about 60 grams. As the dimensions of the handle 14 are important to how the handle 14 performs in shaving one's head, the handle 14 may need to be cored out in order to also obtain the desired weight. Accordingly, the handle 14 may define an opening 32 that extends through a pair of lateral side surfaces 34 (FIG. 1) and 36 of the handle 14. The opening 32 may have a length "L3" of about 30 mm to about 60 mm and more preferably about 40 mm to about 50 mm. The opening 32 may have a height "H1" of about 5 mm to about 15 mm and more preferably about 10 mm to about 15 mm. The handle 14 may have a bottom surface 38 that is generally concave to facilitate the positioning of the handle 14 at a proper angle relative to the head during a shaving stroke. The handle 14 may have a top surface 40, opposite the bottom surface 38 that is generally convex. The maximum thickness "T1" may extend from the top surface 40 to the bottom surface 38. In certain embodiments, the maximum thickness of the handle 14 along the length "L1" may be about 45% to about 60% of width "W2" and more preferably about 50% to about 55%. It is understood that the shaving razor system 10 and handle 14 was designed for head shaving, the dimensions disclosed may provide similar advantages for shaving the face, underarms and other areas.

When consumers shave their head, they tend to take two times the number of strokes as when they shave their face. For example, the average number of strokes for shaving the head may be about 300, but may only be about 150 for shaving the face. During these high number of strokes, consumers adjust their grip more frequently than when they shave their face. These frequent adjustments may be facilitated by a thicker, wider, and shorter handle that can be maneuvered easily inside the palm in all different directions. In consumer tests, a majority of test panelists prefer the present handle design (compared to typical razor handle designs) as providing more control as they adjust grips to shave different areas of their head.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:

a cartridge having a proximal end and a distal end; and a handle having a proximal end connected to the distal end of the cartridge, the handle having an enlarged distal end portion, wherein the handle has a maximum width of 28 mm to 35 mm at the enlarged distal end portion and tapers 10 degrees to 15 degrees along a first length of 60 to 65 mm that extends from a terminal end of the handle to a second width of 20 mm to 25 mm toward the proximal end of the handle and the handle has a maximum thickness of 8 mm to 14 mm along the first length.

2. The shaving razor system of claim 1 wherein the shaving razor system has an overall length from the enlarged distal end portion of the handle to the proximal end of the cartridge of 100 mm to 130 mm.

3. The shaving razor system of claim 1 wherein the handle comprises a neck having a width that is less than the second width.

4. The shaving razor system of claim 3 wherein the second width is positioned between the neck and the enlarged distal end portion.

5. The shaving razor system of claim 1 wherein the handle has a weight of 50 grams to 100 grams.

6. The shaving razor system of claim 1 wherein the handle defines an opening extending through the handle from a first lateral side surface of the handle to a second lateral side surface of the handle.

7. The shaving razor system of claim 6 wherein the opening has a length of 30 mm to 60 mm.

8. The shaving razor system of claim 7 wherein the opening has a height of 5 mm to 15 mm.

9. The shaving razor system of claim 7 wherein the opening has a height of 10 mm to 15 mm.

10. The shaving razor system of claim 1 wherein the handle has a bottom surface that is concave.

11. The shaving razor system of claim 1 wherein the maximum thickness is 45% to 60% of the second width.

12. The shaving razor system of claim 11 wherein the handle has a neck defining a third width less than the second width.

13. The shaving razor system of claim 12 wherein the third width is 10 mm to 15 mm.

14. A handle for a shaving razor system comprising:

a top surface;

a bottom surface;

a proximal end portion configured to attach to a shaving razor cartridge;

a terminal end;

an enlarged distal end portion between the proximal end portion and the terminal end having maximum width of 28 mm to 35 mm measured within 5 mm of the terminal end wherein the handle has a second width of 20 mm to 25 mm between the maximum width and the proximal end portion and a first length of 50 mm to 70 mm between the terminal end and the second width, wherein a maximum thickness from the top surface to the bottom surface is 8 mm to 14 mm along the first length.

15. The handle of claim 14 wherein the handle tapers 10 degrees to 15 degrees along the first length.

16. The handle of claim 14 wherein further comprising a neck having a width that is less than the second width.

17. The handle of claim 16 wherein the second width is positioned between the neck and the enlarged distal end portion.

18. The handle of claim 14 further comprising a pair of lateral side surfaces and an opening extending between the lateral side surfaces.

19. The handle of claim 18 wherein the opening has a length of 30 mm to 60 mm and a height of 5 mm to 15 mm.

20. The handle of claim 19 wherein the handle comprises metal.

* * * * *